US005903237A

United States Patent [19]

Crosby et al.

[11] Patent Number: 5,903,237

[45] Date of Patent: May 11, 1999

[54] ANTENNA POINTING AID

[75] Inventors: Jeffrey W. Crosby, Sherman Oaks, Calif.; Nathan B. Zerbe, Plymouth, Minn.

[73] Assignee: Hughes Electronics Corporation, El Segundo, Calif.

[21] Appl. No.: 08/575,709

[22] Filed: Dec. 20, 1995

[51] Int. Cl.[6] ..... H01Q 3/00

[52] U.S. Cl. ..... 342/359; 343/703

[58] Field of Search ..... 342/359; 343/703

[56] References Cited

U.S. PATENT DOCUMENTS

| | | | |
|---|---|---|---|
| 4,893,288 | 1/1990 | Maier et al. | 367/116 |
| 4,935,746 | 6/1990 | Wells | 343/703 |
| 5,561,433 | 10/1996 | Chaney et al. | 342/359 |

*Primary Examiner*—Theodore M. Blum

*Attorney, Agent, or Firm*—John A. Crook; Michael W. Sales

[57] ABSTRACT

A method and system for pointing a receiver antenna is described herein. The method includes providing an indicator, receiving a signal at the antenna over a series of positions throughout which the antenna is moved, measuring a signal strength of the signal at each position, and causing the indicator to emit an indication signal that reflects the signal strength at each position. The frequency of the indication signal preferably varies non-linearly to the signal strengths, and the difference between successive indication signal frequencies increases as said signal strength increases in order to allow an installer to more effectively perceive the variations in the frequency of the indication signal.

19 Claims, 3 Drawing Sheets

ANTENNA POINTING AID

FIELD OF THE INVENTION

The present invention relates in general to antennas and associated receiver systems. More particularly, the invention relates to an antenna pointing aid to assist in aligning a receiver antenna.

BACKGROUND OF THE INVENTION

Significant advances in wireless radio and satellite telecommunications systems technology have allowed such systems to become both indispensable and commonplace in the everyday activities of people and businesses. These communications systems generally include a transmitter component for sending signals wirelessly to a receiver component. The receiver component is usually connected to an antenna for collecting and feeding signals to the receiver. The design of the antenna is critical to the performance of the entire system, and improvements in antenna technology have contributed to the increased range and reliability typical of modern receivers.

Placement and orientation of the antenna relative to the transmitter component can also be critical to the performance of a receiver. For example, in modern digital satellite communication systems, such as Direct Broadcast Satellite ("DBS") systems, a ground-based transmitter beams an uplink signal to a satellite positioned in a geosynchronous orbit. The satellite in turn relays the signal back to ground-based receivers. The DBS systems allow each household subscribing to the system to receive digital television, audio, data, and video directly from the satellite using a relatively small, directional receiver antenna. The typical DBS satellite receiver antenna is configured as an 18-inch diameter parabolic dish which focuses the signals to a feed/low noise block ("LNB") mounted to the dish. An indoor television set-top decoder module or "IRD" is linked to the antenna via a cable.

Subscribers can currently install direct-to-home satellite receiver antennas without professional assistance or equipment. The relatively small, lightweight receiver dish antenna is mounted outside the home in a direct line of sight with the broadcast satellite, typically southward. Because DBS signals are beamed from a "stationary" geosynchronous satellite, the dish should not need adjustment once it is fixed in place. However, in order to ensure the quality of the signals received by the system, and thus take full advantage of the DBS system's capabilities, it is critical for the antenna to be pointed accurately toward the satellite, or "peaked", to maximize the strength of the received signals.

To peak the antenna in a DBS system, the subscriber or installer points the antenna in the general direction of the satellite, then fine-tunes the alignment by using a signal strength meter displayed on the television screen by the satellite receiver IRD. The subscriber then adjusts the antenna position until the on-screen meter indicates that signal strength and quality has been maximized. To prevent multiple trips between the location of the antenna to inside the home to view the meter, satellite antennas may include a simple alignment indicator mounted to the antenna. The indicator is typically a light-emitting diode ("LED") which operates from feedback signals fed to the antenna by the IRD through the link cable. The LED flashes to alert the installer that the antenna is pointed correctly.

During peaking of the antenna, the LED signal strength indicator typically alerts the installer that signal strength is increasing by flashing at a faster rate. However, the human eye is often not able to discern minuscule changes in flash rate which can correspond to subtle movement of the antenna during alignment. As a result, the antenna peaking procedure for the antenna to maximize the received signal strength may suffer due to inaccurate perception of the indicator.

SUMMARY OF THE INVENTION

The present invention provides a method and system of pointing an antenna to maximize the strength of the signal received by the antenna. The invention may be embodied in a method that includes a series of steps for moving the antenna to an optimal alignment for receiving transmitted signals. Preferably, the method includes providing an indicator, receiving a signal at the antenna over a series of positions throughout which the antenna is moved, measuring a signal strength of the signal at each position, and causing the indicator to emit an indication signal that reflects the signal strength at each position. Preferably, the indication signal varies at a rate having an inverse exponential relationship with the signal strength.

In another aspect of the invention, a light-emitting indicator is mounted on the antenna, and the indicator is activated to emit light at a flash rate corresponding to each of the antenna pointing positions. Furthermore, the differences between successive flash rates increase non-linearly as the corresponding signal strengths increase.

The signal strength is measured within the receiver system or IRD connected to the antenna. Preferably, the indication signal varies in its frequency to reflect the changes in signal strength. As the signal strength progressively increases, the frequency or flash rate increases at a higher and higher rate. The non-linear variation of the frequency provides a more effective indication signal that allows small improvements in signal strength to be more readily and easily perceived by an antenna installer. Thus, the frequency of the indication signal, for example the flash rate of an LED mounted in proximity with the antenna, can increase exponentially as the signal strength received by the antenna increases in various positions. The critical final antenna adjustment position, therefore, is more accurately determined by the installer. Furthermore, the time necessary for aligning the antenna is significantly decreased.

In yet another aspect of the invention, a system is provided for pointing a directional antenna. The system includes a receiver in communication with the antenna that measures received signals to obtain signal strength values and produces feedback signals corresponding to the signal strength values, and an indicator mounted in proximity to the antenna and responsive to the feedback signals. The indicator is capable of emitting indication signals having varying indication signal frequency, and the indication signal frequencies vary non-linearly to the signal strength values. Also, the difference between successive indication signal frequencies increases as the corresponding signal strength increases.

The method and system described herein allows a user to align more easily various types of receiver antennas. Particularly with respect to DBS systems and applications, the method and system provides a convenient means to assist in the installation and pointing of satellite receiver antennas such as narrow-beamwidth dish configurations.

It is to be understood that both the foregoing general description and the following detailed description are exemplary and explanatory and are intended to provide further explanation of the invention as claimed. The invention, together with the further objects and intended advantages, will best be understood by reference to the following detailed description, taken in conjunction with the accompanying drawings.

DETAILED DESCRIPTION OF THE PREFERRED EMBODIMENTS

The present invention includes a method and system for moving a receiver antenna to an optimal alignment position for receiving transmitted signals. The method includes, for example, providing an indicator, receiving a signal at the antenna over a series of positions throughout which the antenna is moved, measuring a signal strength of the signal at each position, and causing the indicator to emit an indication signal that reflects the signal strength at each position. The indication signal preferably varies non-linearly to the signal strengths, and furthermore the difference between successive flash rates increases as the corresponding signal strengths increase. The method is preferably implemented on a conventional satellite receiver system as described below.

Figure 1:
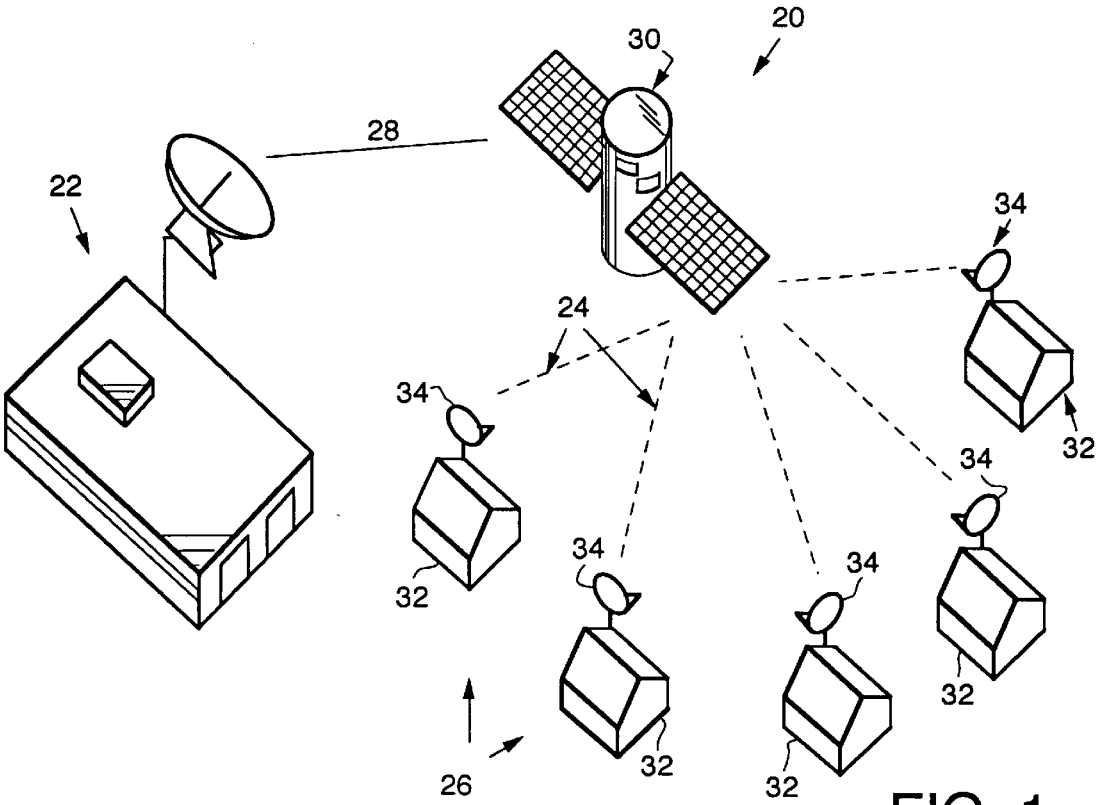
FIG. 1 illustrates a DBS system that is capable of incorporating the antenna pointing aid of the present invention.

Referring now to the drawings, FIG. 1 illustrates a digital satellite system 20 that incorporates the preferred embodiment of the present invention. The system 20 preferably includes a ground-based uplink transmitter 22, a space segment 20 and a plurality of receiving stations 26.

Ground-based transmitter 22 preferably uplinks a digital signal 28 to satellite 30. In a particular application, the digital signals 28 are transmitted to satellite 30 at assigned carrier frequencies between 17.3 GHz to 17.8 GHz. For a direct broadcast satellite (DBS) system, the uplink 28 preferably consists of a plurality of 40 Mbps digital signal carriers having an analog bandwidth of 24 MHz. Adjacent carriers are transmitted with alternating left and right-hand circular polarization to allow frequency overlap of adjacent carriers to conserve available bandwidth. The 24 MHz bandwidth carriers may therefore be spaced with center frequencies only 16 MHz apart. The carriers are quadrature-phase shift keyed (QPSK) modulated, with a symbol rate of 20 Mega symbols/sec, to provide a total bit rate of 40 Mbps.

Satellite 30 receives and translates signal 28 to carrier frequencies between 12.2 GHz to 12.7 GHz for downlink to earth stations. Ordinarily, satellite 30 is a geostationary satellite such as a Hughes® HS-601™ spacecraft positioned at a geostationary orbital location at approximately 101 degrees W longitude. In a particular embodiment, satellite 30 transmits via high-power 120 or 240 watt transponders (not shown) to enable DBS reception within the satellite's downlink footprint. Receiving stations 26, including homes 32 each having receiver antennas 34, are located within the satellite's footprint to receive the transmitted downlink signal 24.

Figure 2:
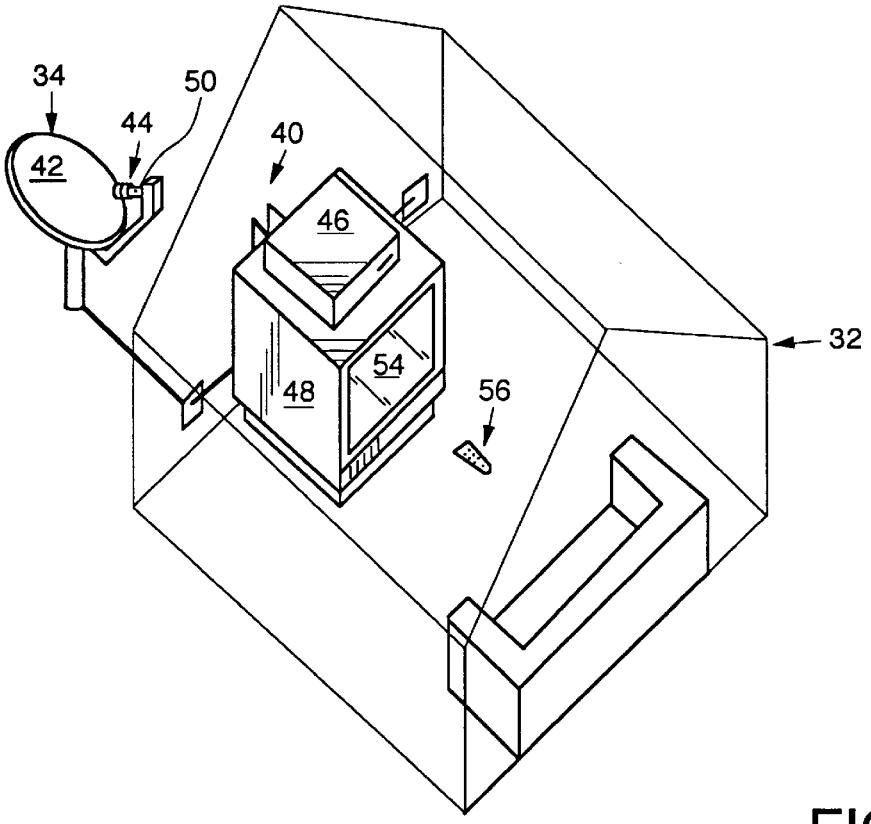
FIG. 2 illustrates a home satellite broadcast receiver system incorporating the present invention.

FIG. 2 illustrates a receiver antenna, alignment system, and satellite broadcast receiver according to the present invention. The receiver system 40 preferably includes a satellite receiver antenna 34 which consists of an 18-inch diameter parabolic dish 42 and a low noise block ("LNB") 44 mounted to the dish 42 for collecting focused signals from the dish 42. The system 40 also includes a satellite broadcast receiver 46 and television monitor 48. The antenna 34 preferably includes an alignment indicator 50 in the form of an LED mounted on the LNB 44 of antenna 34. The LNB 44 is capable of receiving left and right-hand circularly polarized, QPSK-modulated signals in the 12.2 to 12.7 GHz frequency range. An outdoor line 52, preferably a low-voltage DC coaxial connection, links the antenna 34 with the satellite receiver 46. The receiver 46 preferably is an integrated receiver decoder ("IRD") set-top unit for decoding the received broadcast signals from the antenna 34.

During operation, the LNB 44 converts the focused signals to an electrical current which is amplified and down-converted in frequency. The LNB 44 preferably downconverts signals to carrier frequencies between 950 MHz to 1450 MHz. The LNB 44 also includes an amplifier (not shown), which preferably has a low-noise figure between 1.6 and 0.6 dB. The amplified and down-converted signals are then conveyed via line 52 to the indoor satellite receiver 46.

The receiver 46 tunes to a selected 40 Mbps carrier signal within the preferred 950 to 1450 MHz frequency range from the output of LNB 44. A tuner/demodulator within the receiver 46 next decodes the selected Mbps signal carrier into a digital data stream. Preferably, a remote control device or manual switches 56 are provided to select a channel within the carrier selected by the IRD 46. The IRD 46 includes inverse forward error correction ($FEC^{-1}$) logic (not shown) using circuitry or software to detect and correct transmission errors in the data stream. Also, a video/audio decoder and transport logic (not shown) is provided within the IRD 46 to recover the encrypted video signal.

A user interface 54 on the screen of the monitor 48 is conventionally employed to assist the installer of the antenna 34 during the installation and the final alignment or "peaking" process. The user interface 54 can also be a front panel display on the IRD 46. The panel or screen may display signal strength or other positioning information, and provides some means for the installer to alternatively align the antenna 34.

To conventionally install the antenna 34, the installer fixes the antenna 34 to a stable outdoor surface. The antenna is usually initially pointed southward toward the earth's equator. The antenna is then peaked by moving the antenna vertically and horizontally through various elevation and azimuth alignment positions until the on-screen signal strength indicator indoors shows that the received signal strength is maximized.

The preferred embodiment assists in the peaking process by minimizing the hardware and complexity involved optimizing the orientation of a receiver antenna. Thus, a conventional, external signal strength or peak indicator is not necessary. Furthermore, the use of a flashing LED indicator allows the antenna to be peaked in a minimum amount of time.

The system 40 of the preferred embodiment includes a conventional satellite antenna 34, a receiver IRD unit 46, and an indicator 50 mounted on the antenna LNB 44. The IRD 46 is capable of measuring the signal strength of signals received by the antenna 34, and producing corresponding flashing indication signals relating to the signal strength. The indication signals are fed back through an outdoor line 52 to the indicator 50, so that the installer can easily determine how close he or she is orienting the antenna to its optimal signal-receiving position.

Installing the antenna 34 using the illustrated preferred embodiment proceeds as follows. When the IRD 46 is selected to be in an installation mode, the IRD 46 calculates a signal strength value after downconverting the signal received from the antenna 34 via line 52. The signal strength value is then converted by the IRD 46 through conventional means into an indication signal for feedback through the line 52 back to the antenna 34. The indication signal is preferably an intermittent voltage on line 52 to cause the indicator LED 50 mounted on the antenna 34 to illuminate on and off. Preferably, the indication signal energizes at a constant and perceivable flash rate corresponding to the particular signal strength value. The signal strength value is recalculated by the IRD 46 at regular time intervals to take into account any movement of the antenna 34. If the signal strength value differs from the previous measurement, the IRD 46 issues a new indication signal at a different constant flash rate.

The installer then moves the antenna 34 throughout various horizontal and vertical (azimuth and elevational) axes and, while doing so, observes the changing flash rate of the indicator 50. Preferably, the flash rate of the indicator 50 increases as the antenna nears positions where the signal strength received by the antenna 34 becomes greater. When the antenna 34 is positioned where maximum signal strength reception is achieved, the flash rate of the indicator 50 ceases. At this point, the indicator 50 is placed in a constant on mode to signal that optimization is complete. The antenna may then be fixed permanently in this position.

Figure 3:
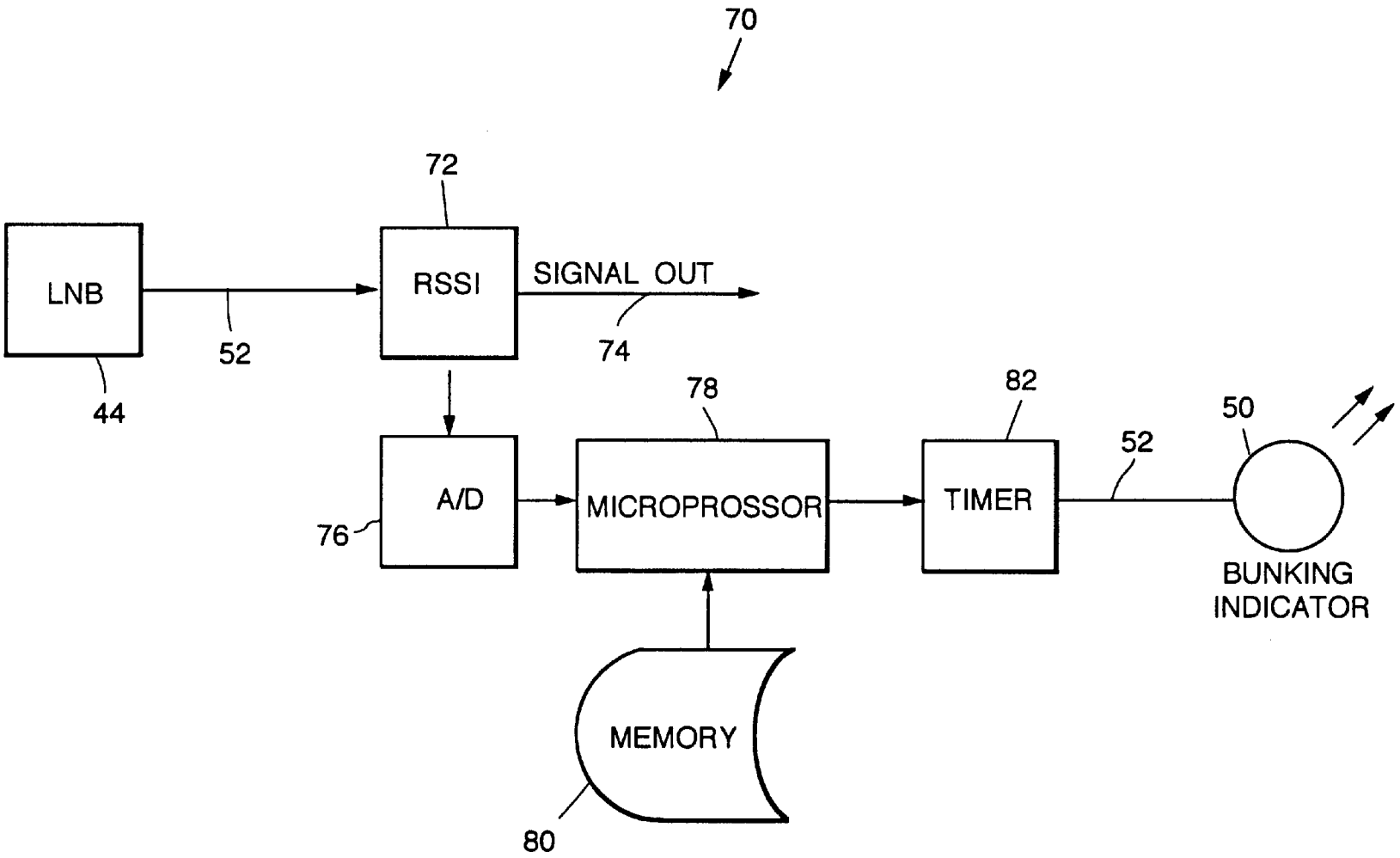
FIG. 3 is a block diagram showing an embodiment of an antenna pointing aid of the present invention.

FIG. 3 shows a more detailed block diagram of a preferred embodiment. The components of system 70 are exemplary and known in the art, and various other implementations of the preferred embodiment may be constructed using conventional methods and components known in the art. The exemplary system 70 as shown in FIG. 3 between the LNB 44 and indicator 50 are preferably implemented within the IRD 46. The system 70 includes a Received Signal Strength Indicator (RSSI) detector 72 linked to an Analog-to-Digital (A/D) converter 76, which is in turn linked to microprocessor 78 and timer 82. A conventional memory 80 is in communication with the microprocessor 78. The system 70 is linked via the detector 72 and line 52 to the LNB 44 of the antenna 34 of the previous figures, and the timer 82 is linked via line 52 to the indicator 50 mounted on antenna 34.

During operation of the system 70, the RSSI detector 72 receives signal strength measurements from the LNB 44. The signal strength measurements are converted in A/D converter 76 into 8-bit digital quantized values for processing within microprocessor 78. The microprocessor 78 determines a corresponding value for the frequency of an indication signal, in this embodiment a flash rate for a light-emitting indicator 50. Programming and stored ranges of values for the microprocessor 78 may be stored within memory 80. The corresponding frequency value is then fed to timer 82, which varies the flash rate of indicator 50 via line 52 in accordance with the frequency value.

During installation, the installer may rotate and raise the antenna 34 throughout its entire range of motion towards the satellite 30. The received signal values periodically received from A/D converter 76 can then be computed into a range of high to low signal strengths which are then stored in memory 80. In this fashion, a corresponding range of flash rates may also be calculated and stored in memory 80.

Figure 4:
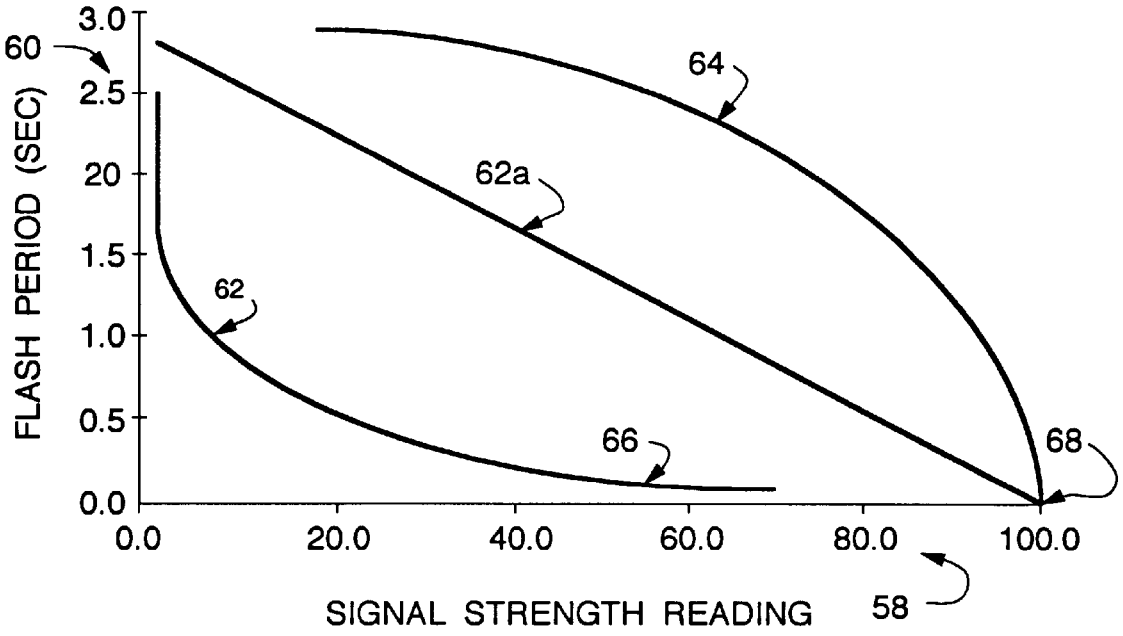
FIG. 4 is a chart showing the relationship between the flash period and the signal strength of the preferred embodiment of the invention.

The graph of FIG. 4 illustrates the relationship between the flash period and the signal strength of the preferred embodiment of the invention. As shown in the figure, the horizontal scale 58 represents the signal strength values measured by the receiver IRD 46 at various pointing positions of the antenna 34. The vertical scale 60 represents the flash period, or time between successive flashes, of the LED indicator 50 mounted on the antenna 34. A previous implementation by SONY® in its DBS system is shown by plot line 62. As shown, the variable flash rate in the previous system has a limited range of between approximately 0.3 and 1 second between flashes. The plot line 62 does not take into account the fact that the human eye is very poor at discerning differences in a flash rate. As the signal strength is maximized, the difference between successive flash periods is extremely low, for example between signal strength readings of 40 and 80 on the shown scale. This can make the perceptibility of the differing flash rates difficult for an installer, especially at higher signal strength readings (see 66). Furthermore, previous implementations also utilized plot line 62a, which also provided a very difficult-to-detect difference in flash rate.

The preferred embodiment is shown by plot line 64, which non-linearly and exponentially increases the flash rate by decreasing the flash period as the signal strength reading approaches a maximum (see 68). The flash period thus varies at an inverse exponential relationship with the signal strength, thus allowing the flash rate to vary approximately exponentially with the signal strength. This enables the eye to detect small improvements in signal strength, and allows an antenna installer to more effectively peak the antenna. Note that the plot line 64 is approximately inverse to the plot line 62. Preferably, the flash rate and flash period becomes zero at the maximum signal strength.

The preferred embodiment of the invention may be implemented through conventional circuit methods known in the art. For example, a microprocessor with random access memory (RAM) and read-only memory (ROM), discrete logic devices (e.g., AND, OR, NAND and NOR gates), field programmable gate arrays (FPGA), application specific integrated circuits (ASICs) may be used to implement the required logic. The implementations can include retaining a scale of signal strengths within system memory, and storing a predetermined set of flash rates permanently matched to a respective signal strength within the system. In the alternative, a divided scale of signal strengths may be determined during a particular alignment session to be between the minimum and maximum signal strengths detected when the antenna is pointed within a range of directions. A corresponding scale of flash rates may then be matched to the scale and transmitted to the indicator.

The preferred embodiment described above allows a user to align or peak an antenna without using any external feedback, such as an on-screen signal strength meter. Thus, the antenna may be properly pointed and aligned in a direction maximizing the received signal strength in less than five minutes, as opposed to an average time of fifteen minutes or more. This time savings is significant if the antennas are placed in difficult-to-reach areas, or if large-scale multiple-antenna installations must be made.

Moreover, the non-linear variance of the indicator flash rate more appropriately suits the human eye's ability to detect changes in flash rates. Installation using a simple flashing LED indicator as illustrated allows for a corresponding simplicity in installation hardware, thus minimizing the cost associated with each receiver and antenna system. Further cost savings may be introduced by eliminating the need for an on-screen signal strength meter feature altogether.

Of course, it should be understood that a wide range of changes and modifications can be made to the preferred embodiments described above. For example, other indicators may be utilized with the preferred embodiment which reflect the changes in indication signal frequency, such as beep generators and tone generators. The beep generators can oscillate so that an audible signal is emitted from a speaker located on or near the antenna at the same time the LED would be illuminated in the preferred embodiment.

In the alternative, a continuous oscillating tone can be utilized, the frequency of the tone varying audibly with the changes in received signal strength. Furthermore, a continuously illuminating light emitter, such as an LED, may be used as a substitute for the flashing indicator, with the intensity or brightness of the LED varying in relation to the signal strength.

Other alternative embodiments of the present invention can utilize detached indicators, or various combinations of the indicators described above. Thus, it is intended that the foregoing detailed description be regarded as illustrative rather than limiting and that it be understood that it is the following claims, including all equivalents, which are intended to define the scope of this invention.

What is claimed is:

1. A method of pointing a directional antenna at a source, said method comprising the steps of:

providing an indicator for emitting indication signals;

moving said directional antenna through a plurality of pointing positions;

measuring a signal strength of a received signal at each of said plurality of pointing positions; and activating said indicator to emit an indication signal having a period which varies in a substantially inverse exponential relation to said measured signal strength to provide sensible information to facilitate pointing of said directional antenna at said source.

2. The method of claim 1 wherein said step of measuring said signal strength is performed by a receiver, said receiver in communication with said antenna via a cable; and said step of activating said indicator further comprises sending a feedback signal from said receiver to said antenna via said cable.

3. The method of claim 1 wherein said period of said indication signal is minimized when said measured signal strength of said received signal is maximized.

4. The method of claim 3 wherein said antenna further comprises a satellite receiver antenna.

5. The method of claim 4 wherein said antenna further comprises a parabolic dish and low-noise block.

6. The method of claim 1 wherein said indicator further comprises a light-emitting means and said indication signals comprise flashing indication signals, each of said flashing indication signals having a flash frequency, said flash frequency of each said flashing indication signal being substantially inversely related to said period.

7. The method of claim 1 wherein said indicator further comprises a tone-emitting means and said indication signals comprise beeping tone indication signals, each of said beeping tone indication signals having a beeping frequency, said beeping frequency of each said beeping tone indication signal being substantially inversely related to said period.

8. The method of claim 1 wherein said indicator further comprises a tone-emitting means and said indicator signals comprise steady tone indication signals, each of said steady tone indication signals having a tone frequency, said tone frequency of each said steady tone indication signal being substantially inversely related to said period.

9. A method of pointing a satellite antenna at a source, said method comprising the steps of:

providing a light-emitting indicator mounted on said antenna, said indicator having a variable flash rate;

moving said antenna through a plurality of pointing positions;

measuring a signal strength of said satellite signal at each of said pointing positions; and causing said indicator to emit light at a flash rate corresponding to the measured signal strength, the flash rate having an associated period which varies in substantially inverse exponential relation to said measured signal strength.

10. A system for pointing a directional antenna at a source, said system comprising:

an antenna;

a receiver in communication with said antenna for measuring signal strength values of signals received by the antenna, said receiver producing feedback signals corresponding to said signal strength values;

an indicator mounted in proximity to said antenna, said indicator being responsive to said feedback signals to emit corresponding indication signals;

wherein each said indication signal has a period which varies in a substantially inverse exponential relation to said measured signal strength value.

11. The system of claim 10 wherein said period of said indication signal is minimized when said signal strength value of said received signal is maximized.

12. The system of claim 10 wherein said antenna further comprises a parabolic dish and a low-noise block; and said indicator further comprises a light indicating means mounted to said antenna.

13. The system of claim 10 wherein said indicator further comprises a light-emitting means and said indicator signals comprise flashing indication signals, each of the flashing indication signals having a flash frequency, said flash frequency of each said flashing indication signal being substantially inversely related to said period.

14. The system of claim 10 wherein said indicator further comprises a tone-emitting means and said indication signals comprise beeping tone indication signals, each of the beeping tone indication signals having a beeping frequency, said beeping frequency of each said beeping tone indication signal being substantially inversely related to said period.

15. The system of claim 10 wherein said indicator further comprises a tone-emitting means and said indication signals comprise steady tone indication signals, each of the steady tone indication signals having a tone frequency, said tone frequency of each said steady tone indication signal being substantially inversely related to said period.

16. A method of pointing a directional antenna at a source, said method comprising the steps of:

providing an indicator for emitting indication signals;

moving said directional antenna through a plurality of pointing positions;

measuring a signal strength of a received signal at each of said plurality of pointing positions; and activating said indicator to emit an indication signal having a period wherein a relationship between said period and said measured signal strength has a negative second derivative.

17. A method of pointing a directional antenna at a source, said method comprising the steps of:

providing a light emitting indicator for emitting visual indication signals;

moving said directional antenna through a plurality of pointing positions;

measuring a signal strength of a received signal at each of said plurality of pointing positions; and activating said indicator to emit an indication signal having a brightness which varies in a substantially inverse exponential relation to said measured signal strength to provide visual information to facilitate pointing of said directional antenna at said source.

18. A system for pointing a directional antenna at a source, said system comprising:

an antenna;

a receiver in communication with said antenna for measuring signal strength values of signals received by the antenna;

an indicator mounted in proximity to said antenna, said indicator being responsive to said measured signal strength values to emit corresponding indication signals;

wherein each said indication signal has a,period and wherein a relationship between said period and a corresponding signal strength value has a negative second derivative.

19. A system for pointing a directional antenna at a source, said system comprising:

an antenna;

a receiver in communication with said antenna for measuring signal strength values of signals received by the antenna;

a light emitting indicator mounted in proximity to said antenna, said indicator being responsive to said measured signal strength values to emit corresponding visual indication signals;

wherein each said indication signal has a brightness which varies in a substantially inverse exponential relation to a corresponding measured signal strength value to provide visual information to facilitate pointing of said directional antenna at said source.

* * * * *